US011162165B2

(12) United States Patent
Seo et al.

(10) Patent No.: US 11,162,165 B2
(45) Date of Patent: Nov. 2, 2021

(54) NICKEL-BASED HEAT-RESISTANT MATERIAL WITH IMPROVED CYCLIC OXIDATION PROPERTIES AND METHOD OF PREPARING THE SAME

(71) Applicant: KOREA INSTITUTE OF MACHINERY & MATERIALS, Daejeon (KR)

(72) Inventors: Seong-Moon Seo, Changwon-si (KR); Dae Won Yun, Changwon-si (KR); Hi Won Jeong, Gimhae-si (KR); Young Soo Yoo, Changwon-si (KR)

(73) Assignee: KOREA INSTITUTE OF MATERIALS SCIENCE, Changwon-si (KR)

( * ) Notice: Subject to any disclaimer, the term of this patent is extended or adjusted under 35 U.S.C. 154(b) by 0 days.

(21) Appl. No.: 16/766,657

(22) PCT Filed: Nov. 20, 2018

(86) PCT No.: PCT/KR2018/014254
§ 371 (c)(1),
(2) Date: May 22, 2020

(87) PCT Pub. No.: WO2019/103428
PCT Pub. Date: May 31, 2019

(65) Prior Publication Data

US 2020/0362445 A1 Nov. 19, 2020

(30) Foreign Application Priority Data

Nov. 24, 2017 (KR) ..... 10-2017-0158201

(51) Int. Cl.
*C22F 1/10* (2006.01)
*C22C 19/05* (2006.01)

(52) U.S. Cl.
CPC ..... *C22F 1/10* (2013.01); *C22C 19/057* (2013.01)

(58) Field of Classification Search
CPC ..... C22C 19/057; C22F 1/10
See application file for complete search history.

(56) References Cited

U.S. PATENT DOCUMENTS

2007/0202003 A1* 8/2007 Arrell ..... C22C 19/057 420/443

FOREIGN PATENT DOCUMENTS

| | | | |
|---|---|---|---|
| JP | 11-310839 | A | 11/1999 |
| JP | 2002-146460 | A | 5/2002 |
| JP | 2011-74492 | A | 4/2011 |
| JP | 2011-74493 | A | 4/2011 |
| KR | 10-2017-0058065 | A | 5/2017 |
| KR | 10-1785333 | B1 | 11/2017 |

OTHER PUBLICATIONS

International Search Report dated Feb. 22, 2019, in connection with corresponding International Patent Application No. PCT/KR2018/014254.

* cited by examiner

*Primary Examiner* — Jessee R Roe
(74) *Attorney, Agent, or Firm* — Hauptman Ham, LLP

(57) ABSTRACT

Disclosed herein is a nickel-based heat-resistant material with improved cyclic oxidation properties. The nickel-based heat-resistant material containing gadolinium (Gd) according to the present invention is capable of suppressing the de-lamination of an oxide layer and increasing stability of the oxide layer, thereby forming an overall thin and uniform oxide layer, and has an advantage in that the formation of a nitride may be suppressed since nitrogen is prevented from penetrating through the oxide layer. In addition, due to the slow oxidation rate, there is an advantage in that an Al depletion layer (a γ' denuded zone) by the formation of an oxide layer may be formed to be very thin compared to that of a specimen having no gadolinium added.

9 Claims, 5 Drawing Sheets

CROSS-SECTION OF OXIDE LAYER OF ALLOY HAVING NO GADOLINIUM ADDED

NICKEL-BASED HEAT-RESISTANT MATERIAL WITH IMPROVED CYCLIC OXIDATION PROPERTIES AND METHOD OF PREPARING THE SAME

CROSS-REFERENCE TO RELATED APPLICATION

The present application is a national stage filing under 35 U.S.C § 371 of PCT application number PCT/KR2018/014254 filed on Nov. 20, 2018 which is based upon and claims the benefit of priority to Korean Patent Application No. 10-2017-0158201, filed on Nov. 24, 2017, in the Korean Intellectual Property Office, which are incorporated herein in their entireties by reference.

BACKGROUND OF THE INVENTION

1. Field of the Invention

The present disclosure relates to a nickel-based heat-resistant material containing gadolinium (Gd) and a method for producing the nickel-based heat-resistant material.

2. Description of the Related Art

A nickel-based heat-resistant superalloy with excellent creep properties is widely used for structural components used at high temperatures such as turbine blades, vanes, and combustors, which are major components of aircraft jet engines or gas turbines used for power generation.

In recent years, as environmental problems such as global warning have emerged, there is a growing need for a method to increase the efficiency of existing power generation methods, along with research on new generation methods to reduce or eliminate $CO_2$ emissions. As a result, the operating temperature of gas turbines is continuously increased to improve efficiency.

A gas turbine combusts compressed air with fuel and the expanded combustion gas rotates the turbine to generate output or generate power.

Therefore, turbine blades, vanes, and the like have three-dimensionally complex aerodynamic designs including an internal cooling passage of a complex shape to obtain higher efficiency under given conditions. For this reason, turbine blades, vanes and the like are manufactured by a casting process which is easy to shape.

In addition, since a turbine blade of a gas turbine operating at a high temperature is subjected to the centrifugal force due to the high-speed rotation of the turbine, the creep properties are very important to withstand the centrifugal force at a high temperature.

The grain boundary of a cast alloy produced by conventional casting process shows poor high-temperature creep properties, and thus, since the 1970's, a directional solidification casting process which improves the creep properties of an alloy by removing a grain boundary perpendicular to stress direction and a single-crystal casting process which completely removes all grain boundaries have been developed and used to manufacture turbine blades.

Together with the development of such processes, alloys for polycrystalline, directional solidification, and single-crystal casting processes have been developed and used.

Among those alloys, a nickel-based heat-resistant superalloy manufactured by the directional solidification casting process is a special alloy which requires excellent oxidation resistance and mechanical properties at a high temperature of about 760° C. or higher. In order to achieve these properties, nickel-based superalloys contain various alloying elements such as chromium (Cr), cobalt (Co), aluminum (Al), titanium (Ti), molybdenum (Mo), tungsten (W), tantalum (Ta), niobium (Nb), carbon (C), boron (B), zirconium (Zr), rhenium (Re), and ruthenium (Ru).

So far, the nickel-based heat-resistant superalloy has been continuously studied for designing an alloy composition having excellent properties since the properties of an alloy vary depending on the kinds and contents of alloying elements, and the combination of specific elements to be added.

The nickel-based heat-resistant superalloy is added with Al, Ti, Ta, and the like to have a precipitation hardening effect by precipitating γ' ($Ni_3(Al,Ti,Ta)$) which is a super lattice reinforcing phase having a L12 structure in a γ phase, which is a matrix, and added with alloying elements such as W, Mo, Re, Cr, and Co to have a solid solution strengthening effect of the matrix, thereby obtaining excellent high-temperature creep strength. In addition, in the case of a grain boundary, fine precipitates are discontinuously precipitated in the grain boundary through the addition of alloying elements such as C, B, and Zr to maintain the high temperature creep strength of the grain boundary.

In particular, in the case of a component used at high temperatures, the creep life thereof until reaching creep rupture is important as described above. However, if the shape of the component changes, it is impossible to continuously use the component for the original purpose thereof or the efficiency thereof is lowered. Therefore, the resistance to initial creep deformation is also a very important factor to be considered in designing an alloy.

However, a typical nickel-based heat-resistant superalloy including the elements causes cracks and de-lamination of an oxide layer, thereby allowing nitrogen to penetrate into a base material through the cracks of the oxide layer resulting in forming needle-shaped aluminum nitrides and forming a thick oxide layer of several tens of μm or more. Therefore, there is a problem in that the high-temperature stability is reduced. Thus, while researching to solve the above problem, the inventors of the present invention discovered that when gadolinium (Gd) was added to the above alloy, the delamination of an oxide layer was suppressed and high-temperature stability was increased, so that an overall thin and uniform oxide layer was formed and completed the present invention.

In this regard, Korean Patent No. 10-1785333 discloses a nickel-based heat-resistant superalloy and a production method thereof.

SUMMARY OF THE INVENTION

The objective of the present invention is to provide a nickel-based heat-resistant material containing gadolinium (Gd) and a method for producing the nickel-based heat-resistant material.

In order to achieve this objective, the present invention provides a nickel-based heat-resistant material with improved cyclic oxidation properties, the nickel-based heat-resistant material including 4 to 7 wt % of cobalt (Co), 3 to 6 wt % of chromium (Cr), 0.1 to 3 wt % of molybdenum (Mo), 2.5 to 6.5 wt % of tungsten (W), 5 to 8 wt % of rhenium (Re), 5 to 6.5 wt % of aluminum (Al), 6 to 9 wt % of tantalum (Ta), 4 to 7 wt % of ruthenium (Ru), 0.01 to 0.1 wt % of gadolinium (Gd), residual nickel (Ni) and other unavoidable impurities.

The present invention also provides a method for producing a nickel-based heat-resistant material, which includes a material preparation step of preparing an alloy material containing 4 to 7 wt % of cobalt (Co), 3 to 6 wt % of chromium (Cr), 0.1 to 3 wt % of molybdenum (Mo), 2.5 to 6.5 wt % of tungsten (W), 5 to 8 wt % of rhenium (Re), 5 to 6.5 wt % of aluminum (Al), 6 to 9 wt % of tantalum (Ta), 4 to 7 wt % of ruthenium (Ru), 0.01 to 0.1 wt % of gadolinium (Gd), residual nickel (Ni) and other unavoidable impurities, a casting step of performing directional solidification casting on the alloy material to produce a cast product, and a solution treatment step of performing homogenization heat-treatment on the cast product.

The nickel-based heat-resistant material containing gadolinium (Gd) according to the present invention is capable of suppressing the de-lamination of an oxide layer and increasing the stability of the oxide layer, thereby forming an overall thin and uniform oxide layer, and has an advantage in that the formation of a nitride may be suppressed since nitrogen is prevented from penetrating through the oxide layer. In addition, due to the slow oxidation rate, there is an advantage in that an Al depletion layer (a γ' denuded zone) by the formation of an oxide layer may be formed to be very thin compared to that of a specimen having no gadolinium added.

BREIF DESCRIPTION OF THE DRAWINGS

The above and other objectives, features and other advantages of the present invention will be more clearly understood from the following detailed description taken in conjunction with the accompanying drawings, in which:

FIG. 1 is a graph showing a change in weight per unit area of a nickel-based heat-resistant material according to a gadolinium content after performing 50 times of a cyclic oxidation test of maintaining at room temperature for 30 minutes after maintaining at 1100° C. for 1 hour according to one Example of the present invention;

DESCRIPTION OF THE PREFERRED EMBODIMENTS

Figure 1:
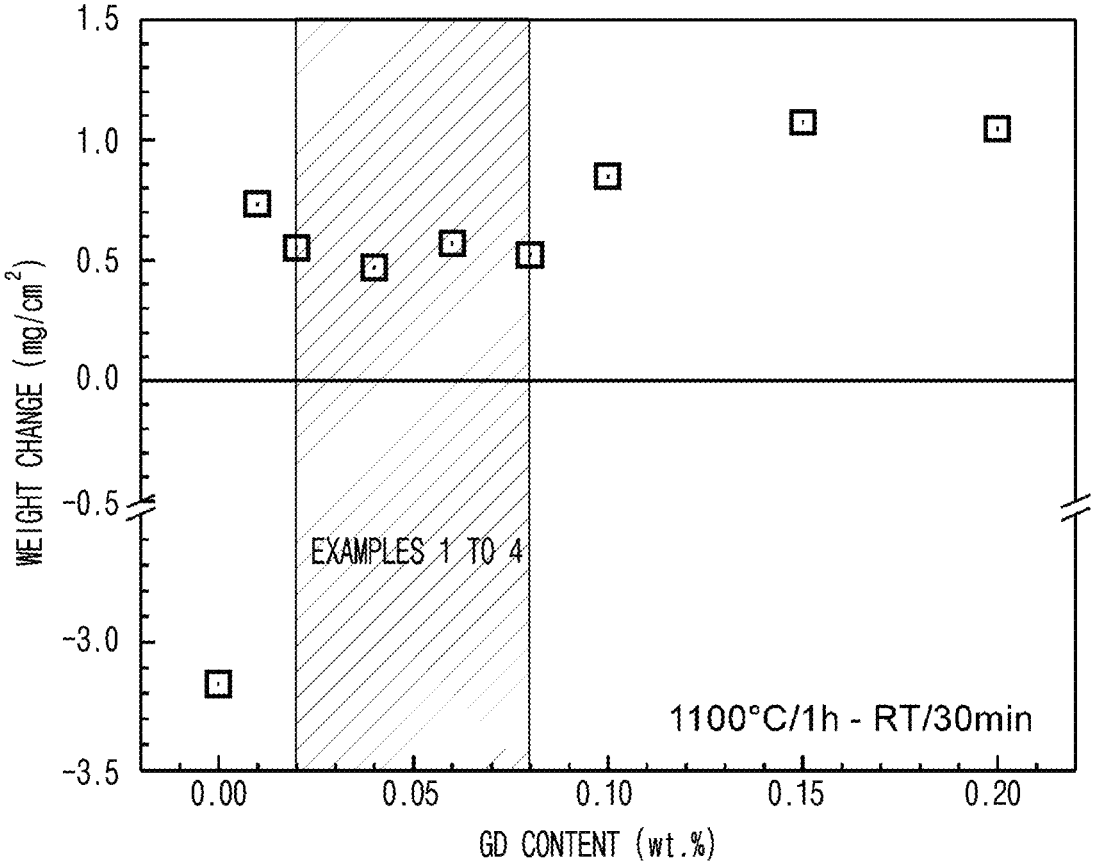

Hereinafter, embodiments of the present invention will be described in detail with reference to the accompanying drawings so that those skilled in the art to which the present application pertains may easily practice the embodiments. The present invention may, however, be embodied in many different forms and should not be construed as limited to the embodiments set forth herein. In addition, in order to clearly describe the present invention, parts irrelevant to the description are omitted in the drawings, and like reference numerals designate like elements throughout the specification.

Throughout the present specification, when a part is referred to as being "connected" to another part, it includes not only the case of "being directly connected," but also the case of "being electrically connected" having another element therebetween.

Throughout the present specification, when a member is referred to as being "on" another member, it includes not only the case in which one member is in contact with another member, but also the case in which yet another member is present between the two members.

Throughout the present specification, when a part is referred to as "including" another component, it means the part may further include other components, rather than excluding other components, unless specifically stated otherwise. The terms "about," "substantially," and the like, as used throughout the present specification, are used in a sense that is close to a numerical value presented with a manufacturing and material tolerance specific to a stated meaning, and is used to prevent an unscrupulous person from abusing a disclosure in which an exact or absolute value is stated in order to facilitate the understanding of the present invention. The term "a step (~ing)," or "a step of ~," as used throughout the present specification, does not mean "a step for."

Throughout the present specification, the term "a combination thereof" included in an expression of the Markush form means one or more mixtures or combinations selected from the group consisting of components described in the expression of the Markush form, and means to include one or more selected from the group consisting of the components.

The present invention provides a nickel-based heat-resistant material with improved cyclic oxidation properties, the nickel-based heat-resistant material including 4 to 7 wt % of cobalt (Co), 3 to 6 wt % of chromium (Cr), 0.1 to 3 wt % of molybdenum (Mo), 2.5 to 6.5 wt % of tungsten (W), 5 to 8 wt % of rhenium (Re), 5 to 6.5 wt % of aluminum (Al), 6 to 9 wt % of tantalum (Ta), 4 to 7 wt % of ruthenium (Ru), 0.01 to 0.1 wt % of gadolinium (Gd), residual nickel (Ni) and other unavoidable impurities.

Hereinafter, a nickel-based heat-resistant material having excellent cyclic oxidation properties according to the first aspect of the present invention will be described in detail.

In one embodiment of the present invention, the nickel-based heat-resistant material may include 4 to 7 wt % of cobalt (Co), 3 to 6 wt % of chromium (Cr), 0.1 to 3 wt % of molybdenum (Mo), 2.5 to 6.5 wt % of tungsten (W), 5 to 8 wt % of rhenium (Re), 5 to 6.5 wt % of aluminum (Al), 6 to 9 wt % of tantalum (Ta), 4 to 7 wt % of ruthenium (Ru), 0.01 to 0.1 wt % of gadolinium (Gd), residual nickel (Ni) and other unavoidable impurities, but is not limited thereto.

In one embodiment of the present invention, the nickel-based heat-resistant material may further include 0.01 to 0.5 wt % of hafnium (Hf), but is not limited thereto.

In one embodiment of the present invention, the nickel-based heat-resistant material may include 0.011 to 0.09 wt % of gadolinium (Gd).

In one embodiment of the present invention, the nickel-based heat-resistant material may include 4 to 7 wt % of cobalt (Co). Cobalt is an alloy element essential to nickel-base heat-resistant materials currently commercially available, and may improve high-temperature strength by reducing the stacking fault energy of a matrix while reinforcing the solid solution of a γ phase, which is a matrix of a nickel-based heat-resistant superalloy. When the content of cobalt is less than 4 wt %, it is difficult to expect an improvement in creep properties due to the weakening of the solid solution strengthening effect of an alloy. When cobalt is added more than 7 wt %, the generation of a brittle TCP phase is promoted, which may deteriorate the high-temperature phase stability and mechanical properties of the alloy.

In one embodiment of the present invention, the chromium (Cr) may be included in an amount of 3 to 6 wt %. In the nickel-based heat-resistant material, chromium may improve the high-temperature corrosion resistance and oxidation resistance of the alloy.

When less than 3 wt % of chromium is added, the high-temperature corrosion resistance of the alloy may be deteriorated. When more than 6 wt % of chromium is added, in an alloy composition in which the phase stability of the alloy is maintained, not only the solid solution strengthening effect may be reduced, but also the generation of the TCP phase may be rapidly increased when exposed at a high temperature.

In one embodiment of the present invention, the molybdenum (Mo) may be included in an amount of 0.1 to 3 wt %. The molybdenum may contribute to the improvement of high-temperature properties of the alloy through strengthening the solid solution of the matrix. When the molybdenum is added in an amount of less than 0.1 wt %, the corrosion resistance of the alloy may be deteriorated, and when added in an amount of more than 3 wt %, the phase stability of the alloy may be reduced.

In one embodiment of the present invention, the tungsten (W) may be included in an amount of 2.5 to 6.5 wt %. Tungsten, which is a refractory element having high density greatly contributes to the solid solution strengthening of a nickel-based heat-resistant superalloy as an element having a very low diffusion coefficient in nickel, and may serve to increase the melting point of the alloy.

However, tungsten has a strong tendency to generate a brittle TCP phase and a strong tendency to be segregated into a solid phase during directional solidification and single-crystal solidification, and thus, may increase the possibility of generating a crystal defect, such as a freckle defect.

Therefore, in order to improve the creep strength through an appropriate solid solution strengthening effect, 2.5 wt % or more of tungsten is added, and in order to suppress a negative effect in terms of main composition and high-temperature mechanical properties due to an excessive addition, the content thereof is limited to 6.5 wt %.

In one embodiment of the present invention, the rhenium (Re) may be included in an amount of 5 to 8 wt %. Excellent mechanical properties at high temperatures may be achieved by including the rhenium, and excellent high-temperature creep strength may be obtained through the solid solution strengthening effect of a matrix. When the rhenium is added in an amount of less than 5 wt %, the high-temperature mechanical properties of the alloy may be greatly reduced, and when added in an amount of more than 8 wt %, the generation of a TCP phase is promoted, so that the high-temperature phase stability of the alloy may be rapidly reduced.

In one embodiment of the present invention, the aluminum (Al) may be included in an amount of 5 to 6.5 wt %. Aluminum is a main forming element of a γ' (Ni3Al) phase which is a main strengthening phase of a nickel-based heat-resistant superalloy. In the nickel-based heat-resistant superalloy, aluminum improves the creep strength of the alloy by precipitation strengthening of the γ' phase, and may contribute to improvement of the oxidation resistance of the alloy by forming a dense oxide layer.

In an alloy to which aluminum of less than 5 wt % is added, the precipitation fraction of a γ' phase is decreased, so that the contribution of aluminum to creep strength is reduced. When aluminum in an amount greater than 6.5 wt % is added, an excessive amount of γ' phase is precipitated, so that high-temperature mechanical properties are deteriorated, and the solvus temperature of the γ' phase is increased to rapidly reduce a heat treatment window (a temperature range between the solvus temperature of the γ' phase and the incipient melting temperature of the alloy) in which solution heat treatment may be performed, making it difficult to perform the solution heat treatment.

In one embodiment of the present invention, the tantalum (Ta) may be included in an amount of 6 to 9 wt %. Tantalum may not only contribute to the solid solution strengthening of a γ phase but also strengthen a γ' phase by substituting aluminum on the γ' phase. In addition, tantalum, which is a high-density refractory element, may be segregated into a liquid phase and increase the density of the liquid phase between dendrites during solidification, thereby attenuating the buoyancy force of an inter-dendritic liquid during directional solidification or single-crystal solidification, and thus, may serve to suppress the generation of a freckle defect.

Therefore, it is preferable to add tantalum in an amount of 6 wt % or greater in an alloy having a high rhenium content of 5 to 8 wt %, but adding tantalum in an amount of greater than 9 wt % may rather promote the generation of a TCP phase, such as a Mu phase, so that high-temperature mechanical properties may be deteriorated.

In one embodiment of the present invention, the ruthenium (Ru) may be included in an amount of 4 to 7 wt %. Excellent phase stability and mechanical properties at high temperatures may be achieved by including the ruthenium, and excellent high-temperature creep strength may be obtained through the solid solution strengthening effect of a matrix. When the ruthenium is added in an amount of less than 4 wt %, the solid solution strengthening effect may be reduced and the phase stability may be deteriorated, and when added in an amount of greater than 7 wt %, the phase stability may rather be reduced.

In one embodiment of the present invention, the hafnium (Hf) may be included in an amount of 0.01 to 0.5 wt %. A strengthening effect of the grain may be achieved by adding the hafnium. In addition, when the hafnium is added in an amount of less than 0.01 wt %, grain strength may be deteriorated, and when added in an amount greater than 0.5 wt %, the amount of coarse eutectic phases generated in the last stage of the solidification of the alloy may be increased.

In one embodiment of the present invention, the gadolinium (Gd) may be included in an amount of 0.01 to 0.1 wt %, preferably 0.011 to 0.09 wt %. The de-lamination of an oxide layer is suppressed and stability is increased by including the gadolinium, so that an overall thin and uniform oxide layer may be formed and maintained. Therefore, nitrogen is prevented from penetrating through the oxide layer, so that the formation of a nitride having a high content of Al may be suppressed. In addition, due to the slow oxidation rate, an Al depletion layer (a γ' denuded zone) caused by the formation of an oxide layer may be formed to be very thin compared to that of a specimen having no gadolinium added (when the γ' denuded zone is thicker, the high-temperature strength of the alloy is more likely to be seriously deteriorated due to the absence of the precipitation strengthening effect of the γ' phase, especially for a thin component).

That is, the gadolinium may be such that a gadolinium oxide is formed on a grain boundary of an $Al_2O_3$ oxide layer to suppress rapid diffusion through the grain boundary, thereby suppressing diffusion through the oxide layer grain boundary, and may be such that the gadolinium oxide prevents the movement of atomic vacancy at the interface between an oxide layer and a base material, thereby lowering the diffusion rate to suppress diffusion at the interface between the oxide layer and the base material. In addition, the gadolinium may suppress the formation of pores at the interface, absorb and remove impurities which lower the bonding force of the interface, and improve the mechanical properties of the oxide layer, thereby increasing the bonding force between the oxide layer and the base material to suppress de-lamination.

The present invention also provides a method for producing a nickel-based heat-resistant material, the method including a material preparation step of preparing an alloy material containing 4 to 7 wt % of cobalt (Co), 3 to 6 wt % of chromium (Cr), 0.1 to 3 wt % of molybdenum (Mo), 2.5 to 6.5 wt % of tungsten (W), 5 to 8 wt % of rhenium (Re), 5 to 6.5 wt % of aluminum (Al), 6 to 9 wt % of tantalum (Ta), 4 to 7 wt % of ruthenium (Ru), 0.01 to 0.1 wt % of gadolinium (Gd), residual nickel (Ni) and other unavoidable impurities, a casting step of performing directional solidification casting on the alloy material to produce a cast product, and a solution treatment step of performing homogenization heat-treatment on the cast product.

The detailed description of parts overlapping the first aspect of the present invention has been omitted. However, the description of the first aspect of the present invention may be equally applied even though the description is omitted in the second aspect.

In one embodiment of the present invention, the method for producing a nickel-based heat-resistant material may first include a material preparation step of preparing an alloy material containing 4 to 7 wt % of cobalt (Co), 3 to 6 wt % of chromium (Cr), 0.1 to 3 wt % of molybdenum (Mo), 2.5 to 6.5 wt % of tungsten (W), 5 to 8 wt % of rhenium (Re), 5 to 6.5 wt % of aluminum (Al), 6 to 9 wt % of tantalum (Ta), 4 to 7 wt % of ruthenium (Ru), 0.01 to 0.1 wt % of gadolinium (Gd), residual nickel (Ni) and other unavoidable impurities.

In one embodiment of the present invention, the alloy material may further include 0.01 to 0.5 wt % of hafnium (Hf), but is not limited thereto.

In one embodiment of the present invention, the alloy material may include 0.011 to 0.09 wt % of gadolinium (Gd).

In one embodiment of the present invention, there may be a composition difference between a dendritic core and an inter-dendritic region due to the segregation of alloying elements during the directional solidification. Particularly, in the inter-dendritic region in which the segregation of γ' phase-forming elements is severe, the formation of the γ' phase is promoted, so that a coarse γ' phase having a higher fraction than that in the dendritic core is generated, and γ/γ' eutectic phase may be formed in the inter-dendritic region during the last stage of the solidification.

In one embodiment of the present invention, after the casting step, a solution treatment step may be performed to homogenize the segregation of the alloying elements and to dissolve coarse γ' precipitates into matrix γ.

In one embodiment of the present invention, the solution treatment step may be performed at about 1,300° C. to about 1,360° C., but is not limited thereto. For example, the solution treatment step may be performed at about 1,300° C. to about 1,360° C., at about 1,310° C. to about 1,360° C., at about 1,320° C. to about 1,360° C., at about 1,330° C. to about 1,360° C., at about 1,340° C. to about 1,360° C., at about 1,350° C. to about 1,360° C., at about 1,300° C. to about 1,350° C., at about 1,300° C. to about 1,340° C., at about 1,300° C. to about 1,330° C., at about 1,300° C. to about 1,320° C., at about 1,300° C. to about 1,310° C., but is not limited thereto. When the solution treatment step is performed at lower than 1,300° C., there may be a disadvantage in that a coarse γ/γ' formed in an inter-dendritic region may not be completely dissolved and may remain in a coarse state, and when performed at higher than 1,360° C., there may be a disadvantage in that incipient melting occurs due to the dissolution of eutectic phases. However, the present invention is not limited thereto.

In one embodiment of the present invention, the solution treatment step may be performed for about 2 hours to about 12 hours, but is not limited thereto. For example, the solution treatment step may be performed for about 2 hours to about 12 hours, for about 4 hours to about 12 hours, for about 6 hours to about 12 hours, for about 8 hours to about 12 hours, for about 10 hours to about 12 hours, for about 2 hours to about 10 hours, for about 2 hours to about 8 hours, for about 2 hours to about 6 hours, or for about 2 hours to about 4 hours, but is not limited thereto. When the solution treatment step is performed for less than 2 hours, there may be a disadvantage in that a coarse γ/γ' formed in an inter-dendritic region may not be completely dissolved and may remain in a coarse state, and when performed for greater than 12 hours, there may be a disadvantage in that a number of Kirkendall pores, which may reduce the fatigue properties at high temperatures, are formed. However, the present invention is not limited thereto.

In one embodiment of the present invention, the method for producing the nickel-based heat-resistant material may further include, after the solution treatment step, a primary aging step of precipitating a γ' phase with optimum values of the size and fraction thereof to exhibit maximum mechanical properties, and after the primary aging step, a secondary aging step of precipitating a very fine secondary γ' phase on the γ channel, which locates between the primary γ' precipitates.

Hereinafter, the present invention will be described in more detail with reference to the following examples and experimental examples.

However, the following examples and experimental examples are only illustrative of the present invention, and the contents of the present invention are not limited by the following examples and experimental examples.

EXAMPLE

Producing Nickel-Based Heat-Resistant Material

Alloy materials including elements according to the contents shown in Examples 1 to 4 and Comparative Examples 1 to 6 of Table 1 shown below were prepared. At this time, the unit of the following element content is wt %. Thereafter, directional solidification casting was performed on each prepared alloy material to produce a cast product, and heat treatment was performed by three processes: solution treatment, primary aging treatment, and secondary aging treatment. The solution treatment was performed for 10 hours at 1,325° C. to homogenize the non-uniform composition between a dendritic core and an inter-dendritic region, which was generated by segregation during casting, and to dissolve coarse eutectic phases formed in the inter-dendritic region. A solution treated specimen was subjected to the primary aging treatment at 1,100° C. for 4 hours. The primary aging treatment was performed to precipitate a γ' phase with optimum values of the size and fraction thereof to exhibit maximum mechanical properties. When the temperature of primary aging treatment is low, the size of the γ' precipitate is decreased, and when the temperature of primary aging treatment is too high, the size of the γ' precipitate is increased, so that the primary aging treatment was performed at the above temperature. In addition, the primary aging treatment was basically performed to obtain a γ' phase having a size of 0.3 to 0.5 μm. Similarly, when performing the primary aging treatment, when the aging treatment time is too short, a γ' phase does not grow up to a desired size, and when the primary aging treatment time is too long, a γ' phase may become coarser than the desired sizes, so that the primary aging treatment was performed for the above amount of time.

After the primary aging treatment, the alloy material was subjected to a secondary aging treatment at 860° C. for 20 hours. The secondary aging treatment was performed to precipitate a very fine secondary γ' phase on the γ channel, which locates between the primary γ' precipitates, after the primary aging treatment.

TABLE 1

| | Co | Cr | Mo | W | Re | Al | Ta | Hf | Ru | Gd |
|---|---|---|---|---|---|---|---|---|---|---|
| Example 1 | 5.6 | 4.5 | 1 | 4.6 | 6.5 | 5.8 | 7.2 | 0.1 | 5.2 | 0.0131 |
| Example 2 | 5.6 | 4.5 | 1 | 4.6 | 6.5 | 5.8 | 7.2 | 0.1 | 5.2 | 0.0345 |
| Example 3 | 5.6 | 4.5 | 1 | 4.6 | 6.5 | 5.8 | 7.2 | 0.1 | 5.2 | 0.0684 |
| Example 4 | 5.6 | 4.5 | 1 | 4.6 | 6.5 | 5.8 | 7.2 | 0.1 | 5.2 | 0.0844 |
| Comparative Example 1 | 5.6 | 4.5 | 1 | 4.6 | 6.5 | 5.8 | 7.2 | 0.1 | 5.2 | — |
| Comparative Example 2 | 4~7 | 3~6 | 0.1~3 | 2.5~6.5 | 5~8 | 5~6.5 | 6~9 | 0.01~0.5 | 4~7 | — |
| Comparative Example 3 | 5.6 | 4.5 | 1 | 4.6 | 6.5 | 5.8 | 7.2 | 0.1 | 5.2 | 0.01 |
| Comparative Example 4 | 5.6 | 4.5 | 1 | 4.6 | 6.5 | 5.8 | 7.2 | 0.1 | 5.2 | 0.1 |
| Comparative Example 5 | 5.6 | 4.5 | 1 | 4.6 | 6.5 | 5.8 | 7.2 | 0.1 | 5.2 | 0.15 |
| Comparative Example 6 | 5.6 | 4.5 | 1 | 4.6 | 6.5 | 5.8 | 7.2 | 0.1 | 5.2 | 0.2 |

Experimental Example 1

The nickel-based heat-resistant material of each of Examples 1 to 4 and Comparative Examples 3 to 6 was subjected to 50 cycles of repeated oxidation to measure a weight change after the cyclic oxidation, and the results are shown in FIG. 1. At this time, for one cycle, the oxidation test was performed at 1,100° C. for 1 hour, then the specimen was cooled to room temperature and maintained for 30 minutes after the oxidation. In the case of Examples 1 to 4, a relatively small weight change of about 0.5 mg/cm$^2$ was observed, whereas in the case of Comparative Examples 3 to 6, it was confirmed that the weight change was large to about 0.7 to 1.2 mg/cm$^2$ after 50 cycles of repeated oxidation tests. In addition, it was confirmed that the weight change was significantly reduced to about −3.2 mg/cm$^2$ when gadolinium was not included in the alloy composition.

Experimental Example 2

Figure 2:
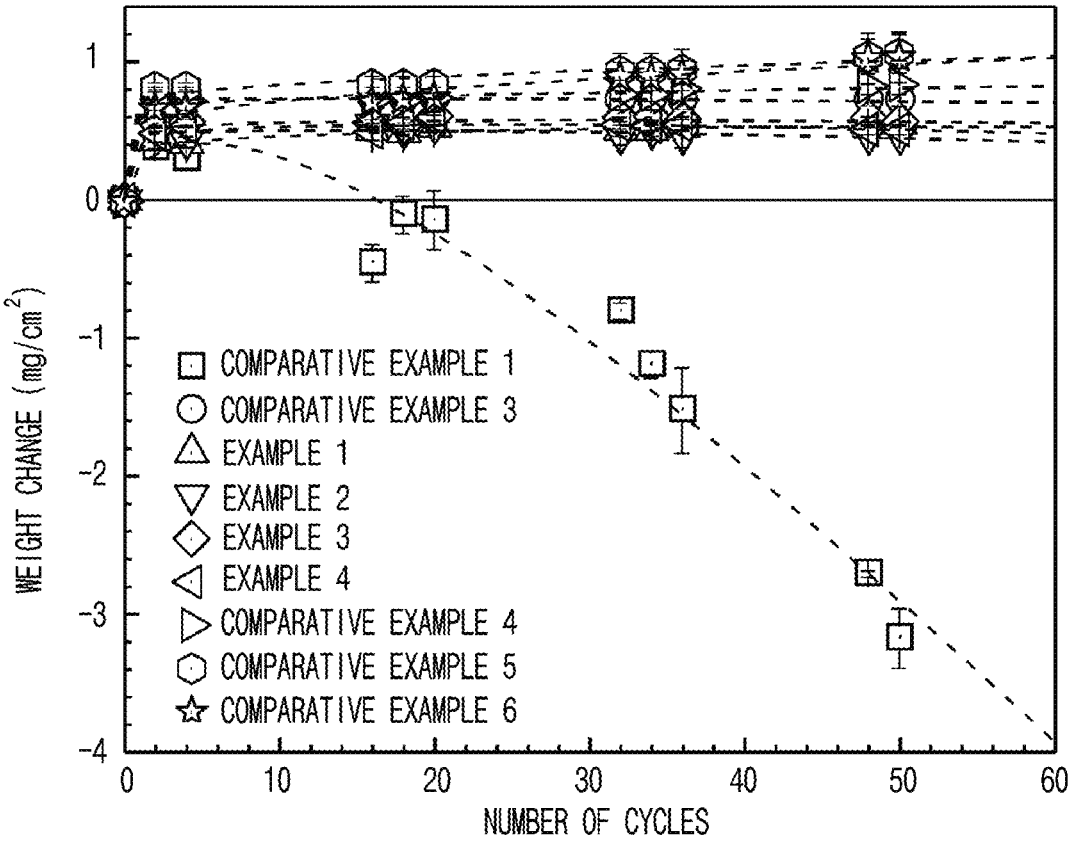
FIG. 2 is a graph showing a change in weight of a nickel-based heat-resistant material according to the number of cycles of repeated oxidation according to one Example and one Comparative Example of the present invention.

The weight change during cyclic oxidation test of the nickel-based heat-resistant material of each of Examples 1 to 4 and Comparative Examples 1 and 3 to 6 was measured and the results are shown in FIG. 2. At this time, the oxidation test was performed at 1,100° C. for 1 hour for one cycle, then the specimen was cooled to room temperature and maintained for 30 minutes after the oxidation. The weight change of the specimen was measured by increasing the number of cycles. As shown in FIG. 2, in the case of Comparative Example 1, since gadolinium was not included, it was confirmed that the weight was rapidly decreased as the number of cycles increased.

Experimental Example 3

Figure 3A:
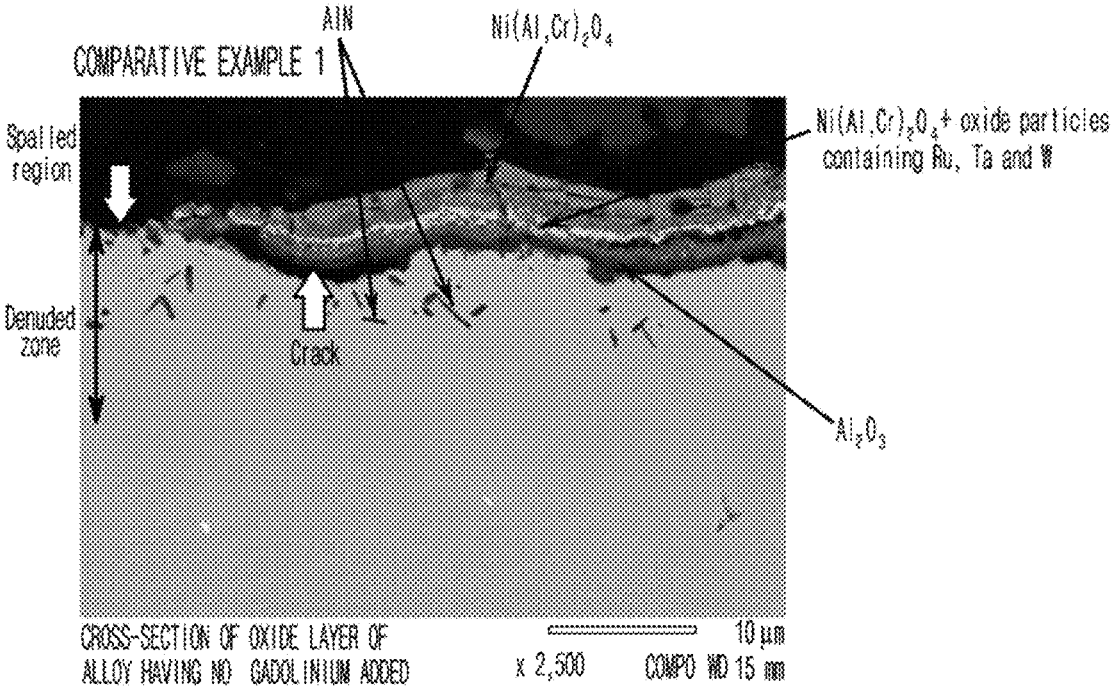
FIGS. 3A and 3B show cross-sectional SEM microstructures of an oxide layer of a nickel-based heat-resistant material according to one Comparative Example of the present invention.
Figure 3B:
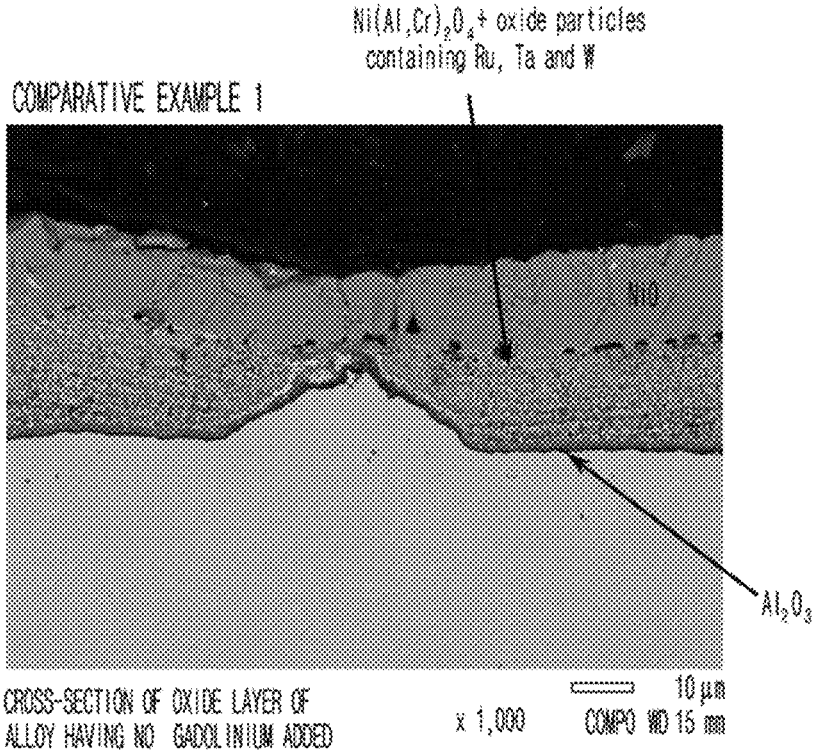
Figure 3C:
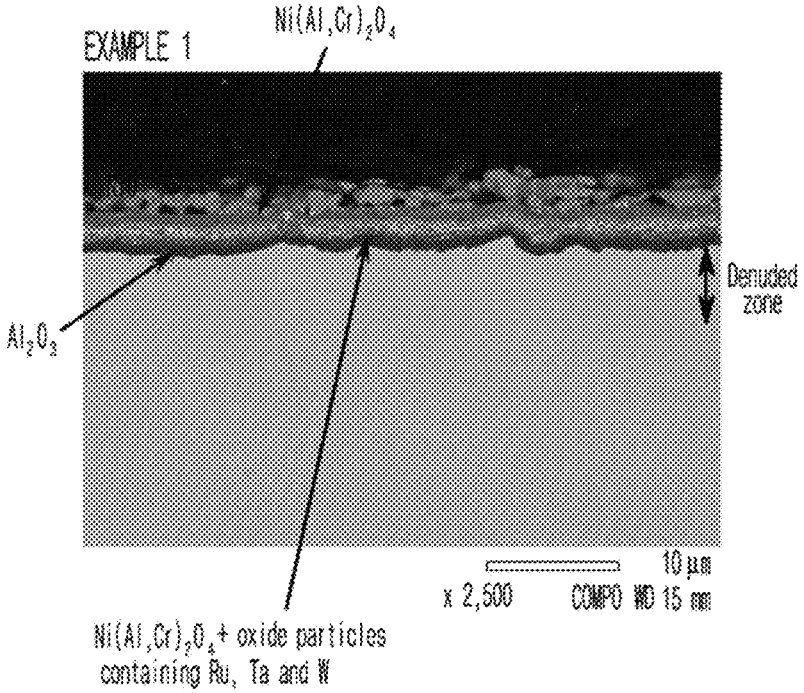
FIG. 3C shows a cross-sectional SEM microstructure of an oxide layer of a nickel-based heat-resistant material according to one Example of the present invention.

The SEM micrographs of the nickel-based heat-resistant material prepared according to each of Comparative Example 1 and Example 1 were taken to confirm the microstructural change after cyclic oxidation tests for 50 cycles, and the results were shown in FIGS. 3A to 3C. FIGS. 3A and 3B are SEM micrographs of the nickel-based heat-resistant material according to Comparative Example 1, in which a number of cracks and de-lamination of an oxide layer were observed, and also, many needle-shaped aluminum nitrides were observed to be famed due to the penetration of nitrogen into a base material through the cracks of the oxide layer. In addition, a thick oxide layer of several tens of μm was also observed to be formed, so that it was confirmed that the stability of the oxide layer was reduced.

On the other hand, FIG. 3C is a SEM micrograph of the nickel-based heat-resistant material according to Example 1 and it was confirmed that an overall thin and uniform oxide layer was formed and maintained after cyclic oxidation tests for 50 cycles since the de-lamination of an oxide layer was suppressed and stability was increased due to the addition of gadolinium. Therefore, nitrogen could not penetrate through the oxide layer, and thus, a nitride was not observed to be formed. In addition, due to the slow oxidation rate, it was confirmed that an Al depletion layer (a γ' denuded zone) by the formation of an oxide layer was formed to be very thin compared to that of a specimen having no gadolinium added (when the γ' denuded zone is thicker, the high-temperature strength is more likely to be seriously deteriorated, especially for a thin component).

What is claimed is:

1. A nickel-based heat-resistant material comprising:
4 to 7 wt % of cobalt (Co);
3 to 6 wt % of chromium (Cr);
0.1 to 3 wt % of molybdenum (Mo);
2.5 to 6.5 wt % of tungsten (W);
5 to 8 wt % of rhenium (Re);
5 to 6.5 wt % of aluminum (Al);
6 to 9 wt % of tantalum (Ta);
4 to 7 wt % of ruthenium (Ru);
0.01 to 0.1 wt % of gadolinium (Gd);
residual nickel (Ni); and
other unavoidable impurities.

2. The nickel-based heat-resistant material of claim 1, further comprising 0.01 to 0.5 wt % of hafnium (Hf).

3. The nickel-based heat-resistant material of claim 1, further comprising 0.011 to 0.09 wt % of gadolinium (Gd).

4. A method for producing a nickel-based heat-resistant material, the method comprising:

a material preparation step of preparing an alloy material containing 4 to 7 wt % of cobalt (Co), 3 to 6 wt % of chromium (Cr), 0.1 to 3 wt % of molybdenum (Mo), 2.5 to 6.5 wt % of tungsten (W), 5 to 8 wt % of rhenium (Re), 5 to 6.5 wt % of aluminum (Al), 6 to 9 wt % of tantalum (Ta), 4 to 7 wt % of ruthenium (Ru), 0.01 to 0.1 wt % of gadolinium (Gd), residual nickel (Ni) and other unavoidable impurities;

a casting step of performing directional solidification casting on the alloy material to produce a cast product; and a solution treatment step of performing homogenization heat-treatment on the cast product.

5. The method of claim 4, further comprising:

after the solution treatment step, a primary aging step of precipitating a γ' phase from a supersaturated γ matrix to exhibit maximum mechanical properties; and after the primary aging step, a secondary aging step of precipitating a very fine secondary γ' phase on the γ channel, which locates between the primary γ' precipitates.

6. The method of claim 4, wherein the alloy material further comprises 0.01 to 0.5 wt % of hafnium (Hf).

7. The method of claim 4, wherein the alloy material further comprises 0.011 to 0.09 wt % of gadolinium (Gd).

8. The method of claim 4, wherein the solution treatment step is performed at 1,300° C. to 1,360° C.

9. The method of claim 4, wherein the solution treatment step is performed for 2 hours to 12 hours.

* * * * *